US006092872A

United States Patent [19]

Beaulieu

[11] Patent Number: 6,092,872

[45] Date of Patent: Jul. 25, 2000

[54] CHAIR WING STRUCTURE

[75] Inventor: Jocelyn Beaulieu, Newmarket, Canada

[73] Assignee: Global Total Office, Downsview, Canada

[21] Appl. No.: 09/429,476

[22] Filed: Oct. 29, 1999

[51] Int. Cl.[7] ..... A47C 7/46

[52] U.S. Cl. ..... 297/284.9; 297/452.36

[58] Field of Search ..... 297/284.1, 284.9, 297/452.34, 452.36

[56] References Cited

U.S. PATENT DOCUMENTS

| | | | |
|---|---|---|---|
| 4,370,000 | 1/1983 | Kazaoka et al. | 297/284.9 |
| 4,536,030 | 8/1985 | Sakurada et al. | 297/284.9 |
| 6,019,428 | 2/2000 | Coltield | 247/284.9 |

FOREIGN PATENT DOCUMENTS 2210366 7/1997 Canada .

*Primary Examiner*—Peter R. Brown
*Attorney, Agent, or Firm*—Bereskin & Parr

[57] ABSTRACT

An office chair has a back with a central portion and respective wings or bolsters on opposite sides of the central portion. The wings are coupled to the main central portion by arm structures that are designed to allow the wings to flex rearwardly from a rest position and back to the rest position in response to forces exerted by a person seated in the chair, but to resist forces tending to move the wings forwardly from the rest position.

9 Claims, 5 Drawing Sheets

CHAIR WING STRUCTURE

FIELD OF THE INVENTION

This invention relates generally to chairs, for example office chairs, and is concerned more particularly with the back structure of such a chair.

BACKGROUND OF THE INVENTION

Generally speaking, relatively little attention has hitherto been paid to the design of backs for office chairs. A typical chair back is a relatively flat upholstered structure with some degree of lateral curvature so that the sides of the back to some extent wrap around the sides of the body of a person seated in the chair.

In the field of automotive seating, seats for sports cars have been developed that wrap quite far around the sides of the body of a person in the seat, so as to laterally restrain the person against high loads when the car is cornering. In some case, the seat has a relatively narrow central portion and a pair of "bolsters" or "wings" that extend outwardly from opposite sides of the back to snugly embrace the user. An example of a seat of this type is disclosed in Canadian patent application No. 2,210,366 (Coffield).

An object of the present invention is to provide a chair, particularly (though not necessarily) an office chair, which has a back structure designed to provide some lateral support to a user of the chair, while allowing for body movement.

SUMMARY OF THE INVENTION

The chair provided by the invention has a seat and a back, in which the back has a central portion, a pair of side portions, one at each side of the central portion, and means coupling the side portions to the central portion while permitting back and forth movement of the side portions from a rest position with respect to the central portion. The coupling means include between each side portion and the central portion, arm structure and second arms, each arm couples the side portion to the central portion for forming the back of the chair, and is flexible to allow the required back and forth movement mentioned previously. The side portion includes means engageable with the second arm in the event that the side portion is subjected to force tending to move the side portion forwardly from the rest position, whereby such movement is resisted by the second arm. At the same time, the arm structure permits normal rearward movement of the side portion from its rest position without interference from the second arm.

The chair back structure of the invention provides advantages in terms of comfort to the user, derived from the use of separate back portions (herinafter called "wings") at the sides of the central portion of the seat back. At the same time, undesirable forward movement of either side portion (which could cause discomfort or even injury to a person seated in the chair) is inhibited. In other words, the user of the chair can rest comfortably against the back of the chair and the wings, if necessary, can flex rearwardly to some extent to accommodate movement of the user's body. However, any accidental impact against either wing from the rear of the chair will be resisted.

Preferably, the two arm structures (one at each side of the central portion of the back) extend outwardly from the central portion and separate wing structures are engaged with the first arms of the respective wing structures in such a fashion that the wing structures securely form part of the back of the chair. The back of the chair may comprise a one-piece plastic moulding that incorporates arm structures at both sides. The wing structures can be provided with sockets into which outer end portions of the respective first arms fit snugly so as to at least substantially eliminate relative movement between the wing structure and the arm to which it is fitted.

Preferably, the first arm of each arm structure has a relatively substantial extent in the direction of the height of the back of the chair so that the wing is securely held against tipping with respect to the back. In a preferred embodiment, the first arm has a pair of "fingers" at its distal end, that are spaced in the direction of the height of the back and received in complimentary sockets on the wing.

The second arm can be received in a recess in the first arm and the first arm can be contoured to facilitate engagement of the wing with the second arm. For example, the wing may be provided with a hook-like formation that extends around the first arm, between the spaced "fingers" referred to previously, and engages the second arm from the rear.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
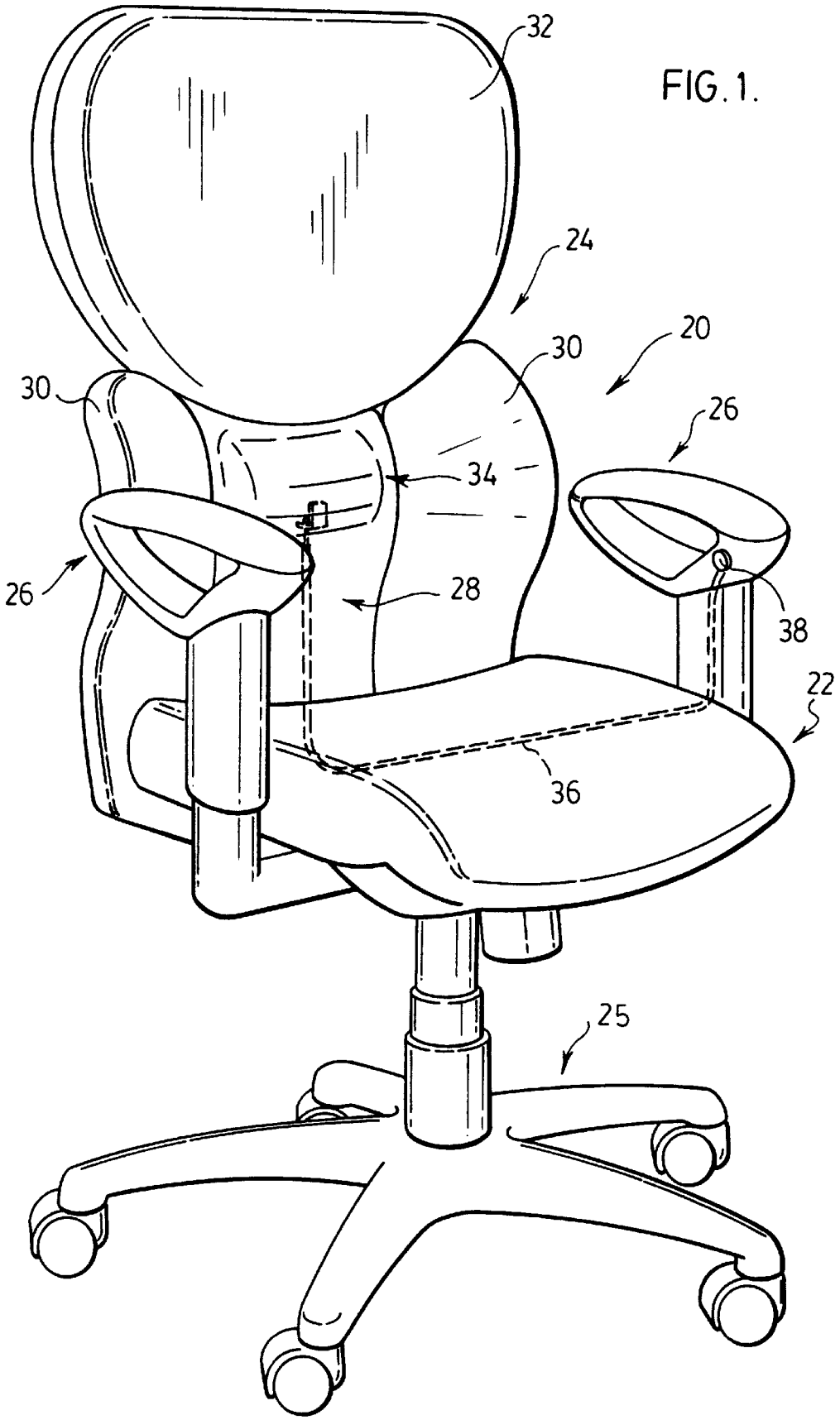
FIG. 1 is a perspective view of an office chair having a back designed in accordance with the principles of the present invention.

Referring first to FIG. 1, an office chair is generally denoted by reference numeral 20 and includes a seat 22 and a back 24. A conventional wheeled base 25 supports the seat of the chair. Arms at respectively opposite sides of the seat are indicated at 26.

The back 24 includes a central portion 28 and a pair of wings or bolsters 30, one at each side of the central portion. A shoulder support portion of the back above the central portion 28 is indicated at 32.

Though not part of the present invention, an adjustable passive lumbar support is incorporated in the central portion 28 of the back and is indicated at 34. A control cable for that support is shown at 36 and extends to a push button 38 in one of the arms 26. The support 34 itself is also visible in FIG. 3. Reference may be made to our co-pending application of even date herewith entitled "Passive Lumbar Support" for details of the lumbar support.

As seen in FIG. 1, the chair is in its upholstered, finished condition. FIGS. 2 to 6 show the internal structure of the back of the chair, without the upholstery. Typically, the components shown in FIGS. 2 to 6 are plastic mouldings. The reference numerals used in FIG. 1 to denote upholstered parts of the chair are also used in FIGS. 2 to 6 to denote the same parts without upholstery.

Figure 2:
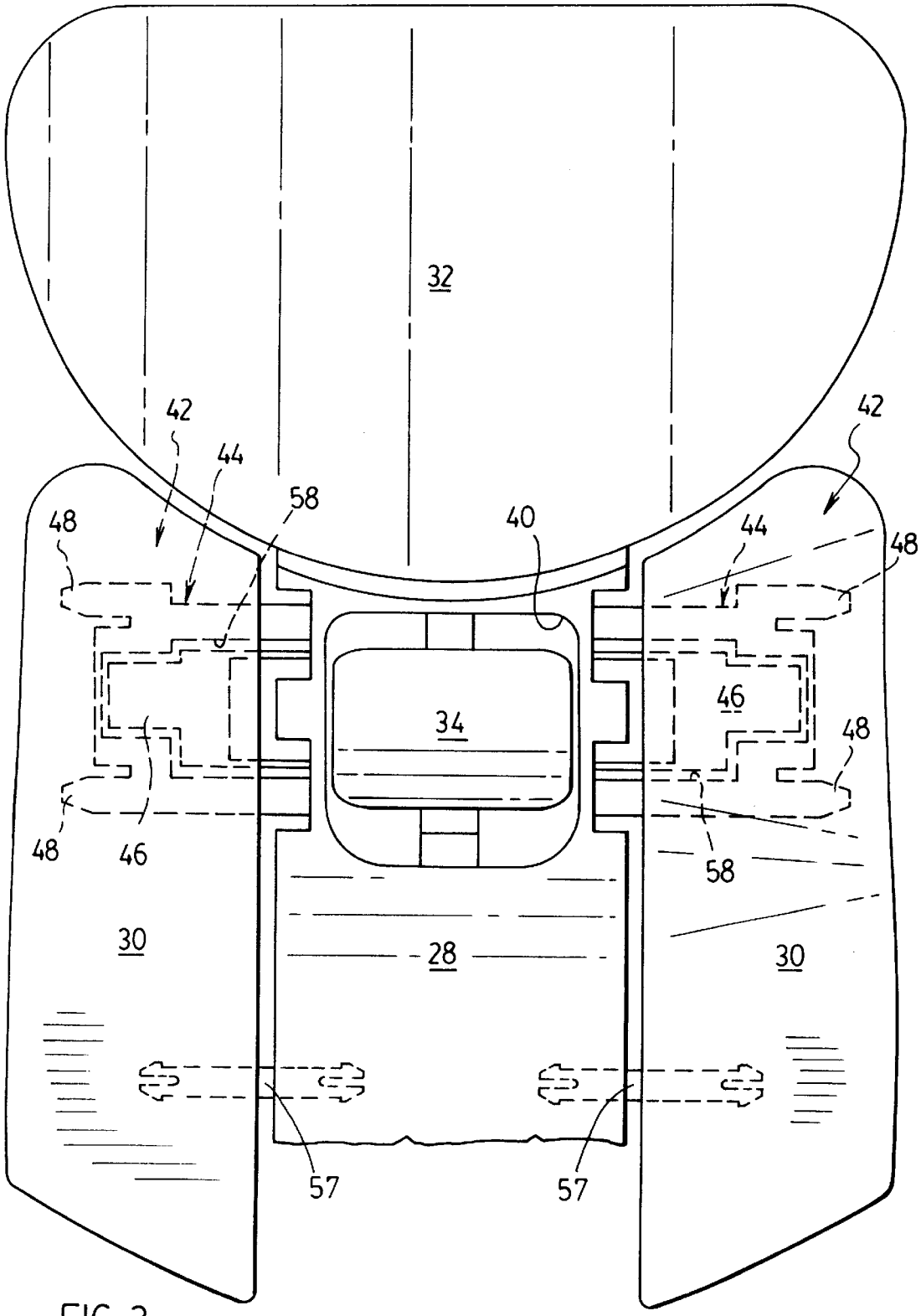
FIG. 2 is a front elevational view of the chair back of FIG. 1.

Referring first to FIG. 2, the two wings 30 are shown on opposite sides of the main central portion 28 of the back. The top portion 32 is moulded integrally with the central portion 28. The adjustable lumbar support 34 is located in a recess 40 in portion 28.

As noted previously, the two wings 30 are coupled to the central portion 28 so as to permit back and forth movement of the wings 30 rearwardly from a rest position with respect to the central portion. In other words, if the rest position shown in FIG. 1, a person seated in the chair can push back on one or both of the wings 30 from the rest position and the wings will flex rearwardly from that rest position and then return to the rest position when pressure is removed. At the same time, any force from the rear in FIG. 1 that would tend to deflect the wings 30 forwardly is resisted.

Figure 3:
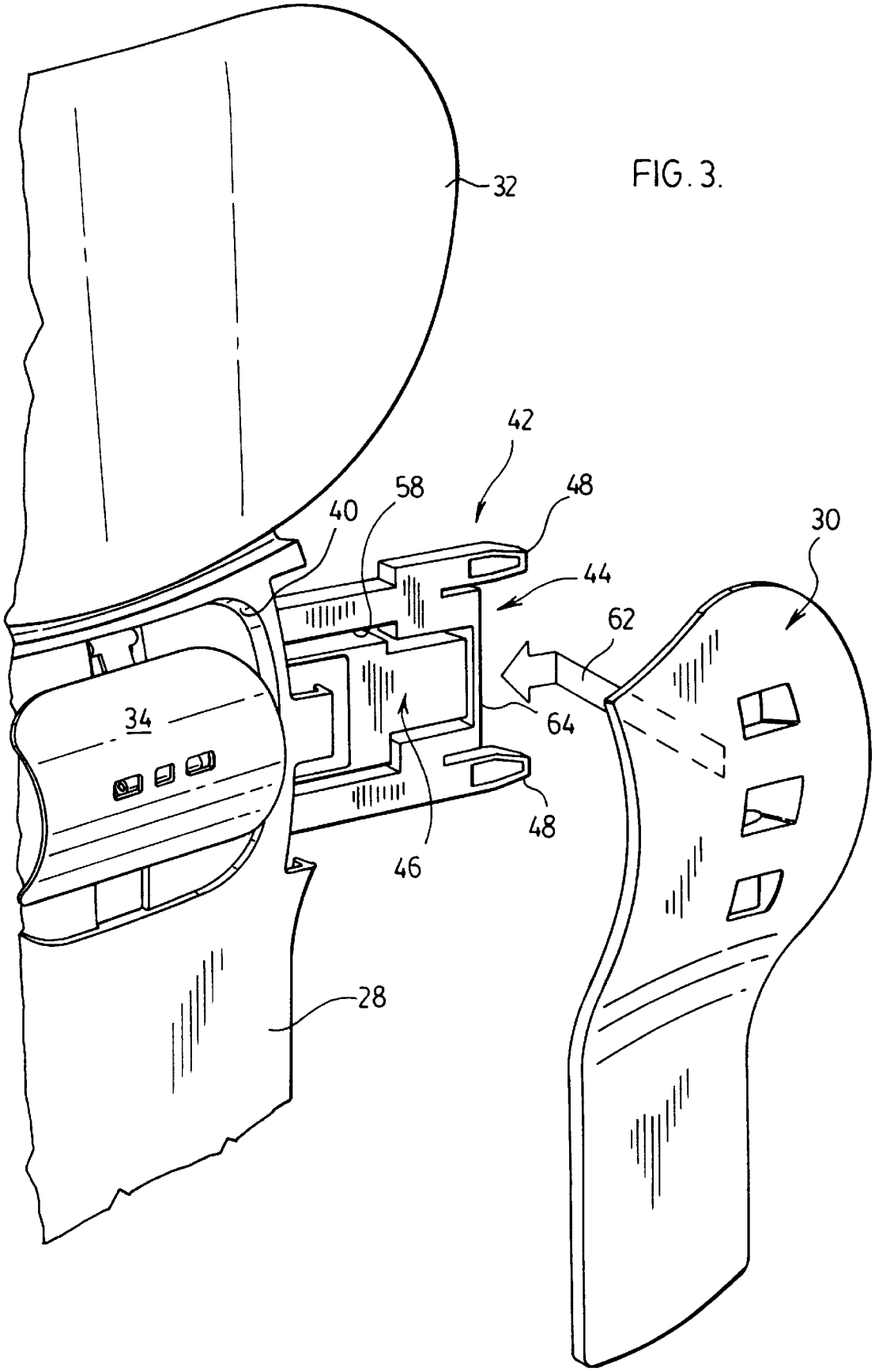
FIG. 3 is a partly exploded perspective view of part of the back and one of the wings of the chair.

These requirements are accomplished by respective arm structures 42 that extend outwardly from opposite sides of the central portion 28 of the back and by which the wings 30 are coupled to that portion. Arm structures 42 are moulded integrally with the back portion 28. The wings 30 and the two arm structures 42 are identical but mirror images of one another. Accordingly, the structure 42 and wing 30 that appear on the right in FIG. 2 will be described as representative of both sides of the chair. In FIG. 3, the arm structure is shown with the associated wing 30 in an exploded position.

Arm structure 42 includes a first arm 44 and a second arm 46. Arm 44 couples the wing 30 to the central portion 28 so that the two components form a unit. Movement of wing 30 with respect to arm 44 is essentially eliminated. At the same time, arm 44 is flexible and allows back and forth movement of the wing 30 from the rest position as described previously. The second arm 46 resists forward movement of the wing 30 from the rest position.

Figure 4:
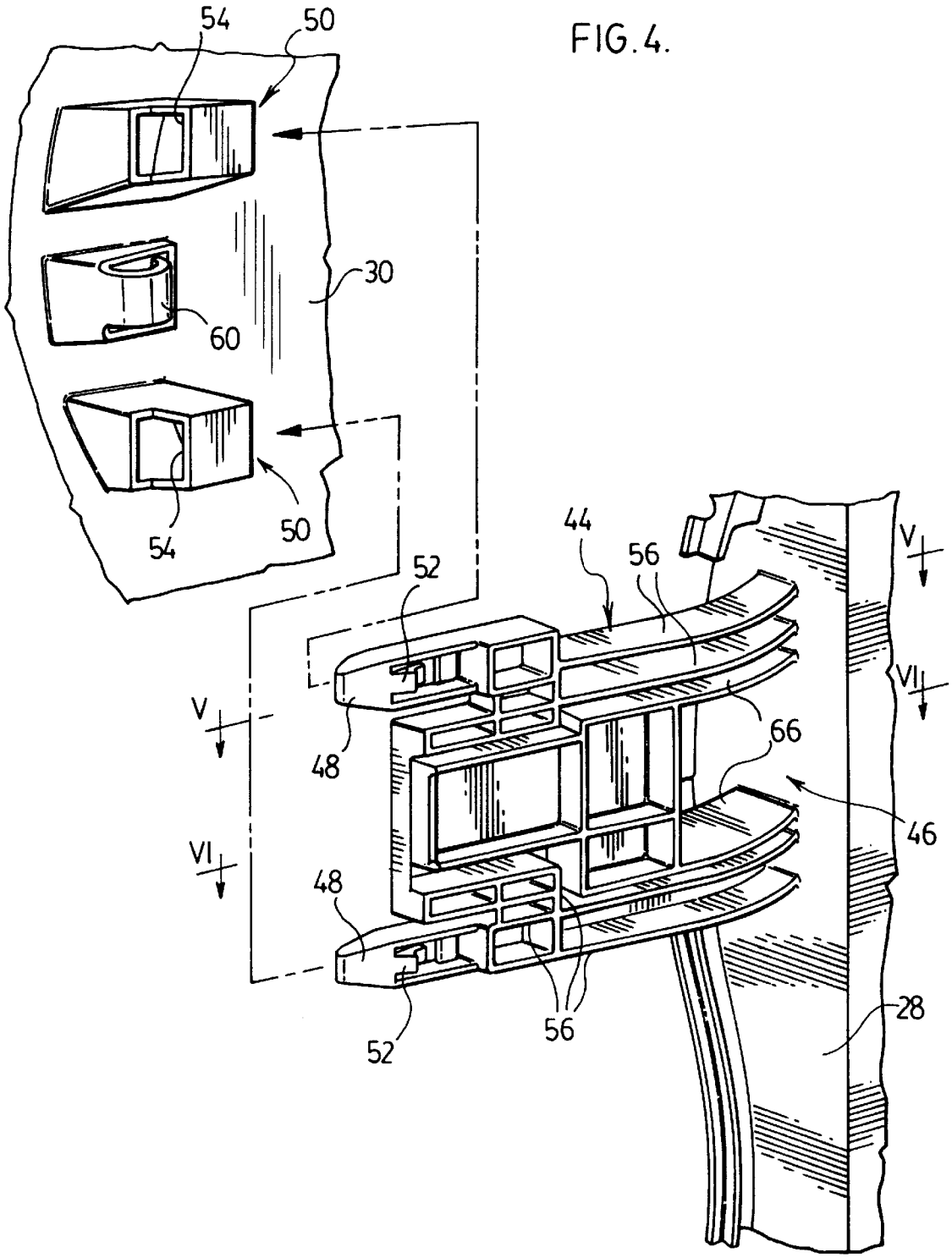
FIG. 4 is a perspective view from the rear in FIG. 3 showing in detail the configuration of the arm structure at the side of the central portion of the back of the chair, and in exploded positions, complimentary parts of the wing and, FIGS. 5 and 6 are sectional views on lines V—V and V1—V1 of FIG. 4 respectively.

The first arm 44 is of significant extent in the direction of the height of the back of the chair and includes a pair of spaced "fingers" 48 that engage snugly in a pair of complimentary sockets 50 formed on the rear face of wing 30 as shown in FIG. 4. A pair of integral latches 52 at the rear sides of the fingers 48 snap into openings 54 in the respective sockets 50 to prevent removal of the wing in normal use of the chair. At the same time, this arrangement does allow for removal of the wing after its upholstery has been removed, for example, to replace a damaged wing or substitute a wing of different design.

Reverting to FIG. 3, it will be apparent that the significant height-wise extent of the first arm 44 and the fact that the two fingers 48 are relatively widely spaced means that any tendency of the wing 30 to tip with respect to the arm structure 42 is resisted. At the same time, the arm structure itself is designed to be resistant to twisting. FIG. 4 shows the arm structure as seen from the rear and it will be seen that the structure includes substantial web structures, generally indicated at 56, that are designed to resist twisting of the arm.

Also, in this particular embodiment, a pair of snap-in straps 57 are provided between the central portion 28 of the back and the respective wings 30 to align lower portions of the wings with the central portion of the back. These straps do not impede flexing of the wings.

FIG. 3 shows that the second arm 46 is located within a recess 58 in the first arm 44. FIG. 4 shows a hook-shaped formation 60 that is provided on the rear face wing 30 between the two sockets 50. Formation 60 is designed to "reach" around the first arm 44 and engage the distal end portion of the second arm 46 at the rear of the arm structure 42. This is indicated by the arrow 62 in FIG. 3. The spacing between the fingers 48 accommodates the formation 60. At the same time, the end wall or web 64 of the first arm 44 between the fingers 48 is relatively thin, so that the formation 60 does not need to be of significant longitudinal extent.

The second arm 46 is intended to be relatively inflexible so as to firmly resist any force tending to move wing 30 in the forward direction. To this end, it will be seen from FIG. 4 that the first arm 46 includes much deeper webs 66 than the corresponding portions 56 of the first arm.

Figure 5:
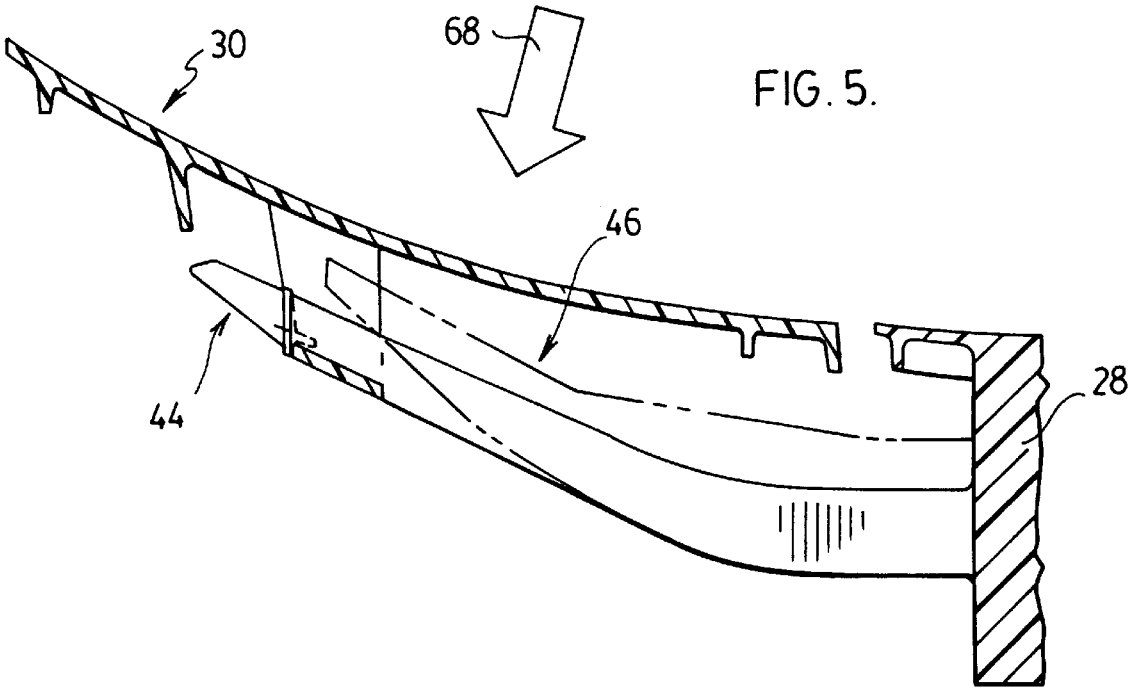

FIG. 5 illustrates flexing of the wing 30 in response to a normal force applied rearwardly to the wing as by a person seated on the chair leaning on the wing. The force is represented by arrow 68. The first arm 44 is shown as having flexed with respect to the second arm 46 as the wing 30 moves back from its normal rest position. When the force 68 is removed, arm 44 will return the wing to its rest position.

In normal flexure, wing 30 will not contact arm 46. However, the arm does also act as a precautionary stop against over-flexure of the arm 44. In other words, an excessive force 68 would be resisted when the wing 30 contacts the arm 46.

Figure 6:
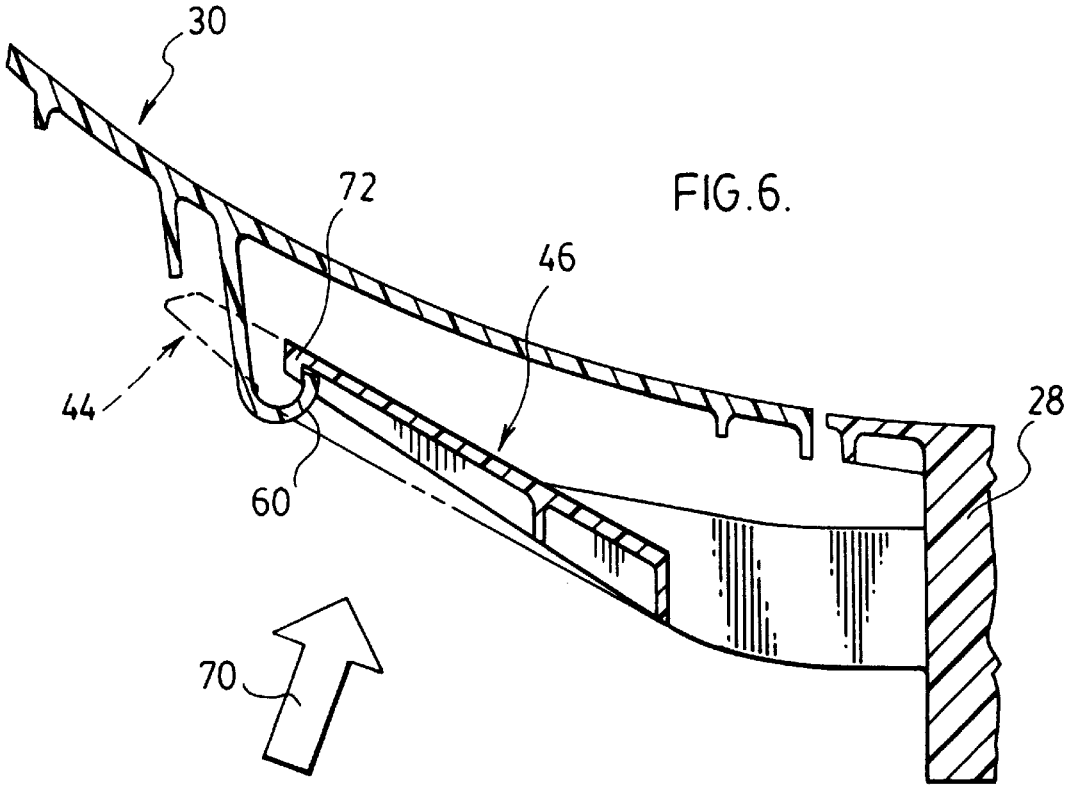

FIG. 6 shows a force 70 applied from behind the wing 30. It can be seen that the formation 60 engages behind a lip 72 formed by an end wall of arm 46. Arm 46 resists any significant forward movement of the wing 30.

In summary, the invention provides a seat back design that allows for the use of wings or bolsters to relatively closely conform the back to the body of a person using the seat. The wings or bolsters can flex back and forth rearwardly from a normal rest position in response to forces exerted by a person using the seat. However, in the event that unintentional impacts or other forces are applied from the rear, forward flexing of the wing is resisted by the second arm 46 and the user of the chair is not discomforted or even possibly injured.

It will of course be appreciated that the preceding description relates to a particular preferred embodiment of the invention only and that many modifications are possible within the broad scope of the invention. Some of those modifications have been indicated previously and others will be apparent to a person skilled in the art. For example, the arm structures 42 could extend inwardly from the wings 30 and engage in sockets on the central portion of the back. Obviously, the wings themselves can vary in design and configuration. In the illustrated embodiment, the first arm 44 is essentially a double arm linked by a plastic web. This has advantages in terms of resisting of twisting of the arm but may not be essential in other applications. For example, two separate elements could be used as the first arm, or only a single element.

It should finally be noted that, while the invention has been described in the context of an office chair, there is no limitation in this respect. The principles of the invention could be used in the design of a back for a chair for domestic or other use.

I claim:

1. A chair having a seat and a back, wherein the back comprises a central portion, a pair of side portions, one at each side of the central portion, and means coupling the side portions to the central portion while permitting back and forth movement of the side portions rearwardly from a rest position with respect to said central portion, said coupling means comprising, between each said side portion and the central portion, an arm structure that includes first and second arms, said first arm coupling the side portion to the central portion for forming the back of the chair and being flexible to allow said back and forth movement of the side portion rearwardly from said rest position, and means on said side portion engageable with said second arm in the event that said side portion is subjected to force tending to move the side portion forwardly from said rest position, said second arm resisting such movement, said arm structure permitting normal rearward movement of the side portion from said rest position without interference by said second arm.

2. A chair as claimed in claim 1, wherein the arm structures extend outwardly from said central portion of the seat back, and wherein said side portions of the seat back are separate but coupled to the first arms of the respective arm structures so as to be at least substantially immovable with respect to said first arms.

3. A chair as claimed in claim 2, wherein said first arms are received in respective sockets on rear faces of the said side portions.

4. A chair as claimed in claim 3, wherein each said first arm includes a pair of fingers at a distal end of the first arm, said fingers being spaced significantly in the direction of the height of the back of the chair, and received in respective said sockets on said inner face of the relevant said side portion of the back.

5. A chair as claimed in claim 4, wherein each said finger includes a latch that snaps into a complimentary opening in the socket in which the finger is received, for securing the wing structure to the first arm and preventing separation of the side portion from the arm during normal use of the chair.

6. A chair as claimed in claim 4, wherein said second arm is received in a recess in the first arm and extends to a location between said fingers of the first arm.

7. A chair as claimed in claim 6, wherein said means on said side portions engageable with said second arm in the event that the side portion is subjected to a force tending to move the side portion forwardly from said rest position, comprises a hook-shaped formation on each side portion that extends between said fingers of the first arm and engages the second arm at a rear side thereof, whereby the formation engages the second arm in response to a force tending to move the side portion of the back forwardly but is free to move rearwardly with respect to the second arm.

8. A chair as claimed in claim 7, wherein said central portion of the back and arm structures comprise a one-piece plastic moulding and wherein said first and second arms include web structures at rear sides of the respective arms, said web structures being deeper on said second arm than on said first arm, so that the second arm is essentially non-deflectable in the forward direction from said rest position.

9. In a chair having a seat and a back in which the back comprises a central portion and a pair of side portions, one at each side of the central portion;

the improvement comprising:

means coupling the side portions to the central portion while permitting back and forth movement of the side portions rearwardly from a rest position with respect to said central portion, said coupling means comprising, between each said side portion and the central portion, an arm structure that includes first and second arms, said first arm coupling the side portion to the central portion for forming the back of the chair and being flexible to allow said back and forth movement of the side portion rearwardly from said rest position, and means on said side portion engageable with said second arm in the event that said side portion is subjected to force tending to move the side portion forwardly from said rest position, said second arm resisting such movement, said arm structure permitting normal rearward movement of the side portion from said rest position without interference by said second arm.

* * * * *